US011440086B2

(12) United States Patent
Ishii

(10) Patent No.: US 11,440,086 B2
(45) Date of Patent: Sep. 13, 2022

(54) METHOD FOR PRODUCING CU—NI—SN ALLOY AND COOLER TO BE USED FOR SAME

(71) Applicant: NGK INSULATORS, LTD., Nagoya (JP)

(72) Inventor: Kensuke Ishii, Handa (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 17/206,285

(22) Filed: Mar. 19, 2021

(65) Prior Publication Data

US 2021/0299744 A1 Sep. 30, 2021

(30) Foreign Application Priority Data

Mar. 30, 2020 (JP) ..... JP2020-060359
Mar. 2, 2021 (JP) ..... JP2021-032852

(51) Int. Cl.
*B22D 11/124* (2006.01)
*B22D 11/00* (2006.01)
*C22C 9/06* (2006.01)

(52) U.S. Cl.
CPC ..... *B22D 11/1246* (2013.01); *B22D 11/004* (2013.01); *C22C 9/06* (2013.01)

(58) Field of Classification Search
CPC ..... B22D 11/00; B22D 11/004; B22D 11/049; B22D 11/124; B22D 11/1246; B22D 11/225; C22C 9/06
USPC ..... 164/486, 444
See application file for complete search history.

(56) References Cited

U.S. PATENT DOCUMENTS

| | | | |
|---|---|---|---|
| 3,623,536 A | 11/1971 | Moritz | |
| 3,713,479 A | 1/1973 | Bryson | |
| 8,641,837 B2 | 2/2014 | Aruga et al. | |
| 2006/0180293 A1 | 8/2006 | Maehara et al. | |

FOREIGN PATENT DOCUMENTS

| | | | | |
|---|---|---|---|---|
| CN | 108677059 A | * | 10/2018 | ..... C22C 9/06 |
| JP | H04-309438 A1 | | 11/1992 | |
| JP | 2007-169741 A1 | | 7/2007 | |
| WO | 96/41033 A1 | | 12/1996 | |

OTHER PUBLICATIONS

Machine translation of CN 108677059 A (Year: 2018).*
Extended European Search Report (Application No. 21163991.9) dated May 6, 2021.

* cited by examiner

*Primary Examiner* — Kevin P Kerns
(74) *Attorney, Agent, or Firm* — Burr & Brown, PLLC

(57) ABSTRACT

There is provided a method for producing a Cu—Ni—Sn alloy by a continuous casting method or a semi-continuous casting method, the method including pouring a molten Cu—Ni—Sn alloy from one end of a mold, both ends of which are open, and continuously drawing out the alloy as an ingot from the other end of the mold while solidifying a part of the alloy, the part being near the mold; and spraying mist-like liquid on the drawn-out ingot to cool the ingot, thereby making a cast product of the Cu—Ni—Sn alloy.

8 Claims, 2 Drawing Sheets

METHOD FOR PRODUCING CU—NI—SN ALLOY AND COOLER TO BE USED FOR SAME

CROSS-REFERENCE TO RELATED APPLICATIONS

This application claims priority to Japanese Patent Application No. 2020-060359 filed Mar. 30, 2020 and Japanese Patent Application No. 2021-032852 filed Mar. 2, 2021, the entire contents all of which are incorporated herein by reference.

BACKGROUND OF THE INVENTION

1. Field of the Invention

The present invention relates to a method for producing a Cu—Ni—Sn alloy and a cooler for use in the same.

2. Description of the Related Art

In the past, a copper alloy, such as a Cu—Ni—Sn alloy, has been produced by a continuous casting method or a semi-continuous casting method. The continuous casting method as well as the semi-continuous casting method is one of the main casting methods and is such that a molten metal is poured into a water-cooled mold to be solidified continuously and drawn out as an ingot having a certain shape (such as a rectangular shape or a round shape), and the ingot is drawn out downward in many cases. This method produces an ingot in a perfectly continuous manner and therefore is excellent in producing a large amount of an ingot having constant components, quality, and shape, but is unsuitable for production of wide variety of ingots. The semi-continuous casting method, on the other hand, is a batch type casting method by which the length of an ingot is limited, and in the semi-continuous casting method, the product class and shape/size can be changed variously. In addition, a large-sized coreless furnace has been used in recent years, so that increasing the size of a cross section of an ingot, lengthening an ingot, and casting a large number of ingots at a time have been enabled, and therefore the semi-continuous casting method can have productivity which is comparable to that of the continuous casting method.

For example, Patent Literature 1 (JP2007-169741A) discloses that when a copper alloy is produced, the copper alloy having a predetermined chemical component composition is smelted in a coreless furnace and then subjected to ingot casting by a semi-continuous casting method to obtain an objective ingot. The obtained ingot is then cooled and is subjected to predetermined steps, such as rolling, and an objective alloy is thereby obtained.

CITATION LIST

Patent Literature

Patent Literature 1: JP2007-169741A

SUMMARY OF THE INVENTION

However, when an ingot obtained by solidifying a molten metal in a casting step is cooled, the speed of cooling the ingot gives an influence on the productivity and product quality of an alloy to be obtained finally. For example, when the cooling speed is fast, internal cracks occur in the ingot to deteriorate the product quality of the alloy to be obtained. By contrast, when the cooling speed is slow, the internal cracks in the ingot can be suppressed, but cooling requires a time, and therefore the productivity of the alloy to be obtained becomes poor. Therefore, in the production of an alloy, the productivity and product quality of the alloy are in a trade-off relationship, and achieving both the productivity and the product quality is desired.

Particularly when a copper alloy containing Sn having a low melting point (such as a Cu—Ni—Sn alloy) is made into an ingot, the internal stress in a solidifying process is large at the outside and inside of the ingot. For example, when the ingot is cooled with a water-cooling shower, by immersion into a water tank, or the like, which is a cooling method which has been performed in the past, the internal cracks are liable to occur in the ingot because the cooling speed is too fast. Even when the cooling speed is slowed by, for example, air-cooling in order to suppress the occurrence of the internal cracks, cooling requires 12 hours or longer in some cases, and therefore the productivity is remarkably poor.

As the Cu—Ni—Sn alloy, Cu-15Ni-8Sn alloy defined as UNS: C72900, Cu-9Ni-6Sn alloy defined as UNS: C72700, and Cu-21Ni-5Sn alloy defined as UNS: C72950, and the like are known. As described above, the internal cracks are liable to occur in a copper alloy containing Sn having a low melting point, and among the Sn-containing copper alloys, when the Cu-15Ni-8Sn alloy with a high Sn content is produced, the influence of the speed of cooling the ingot on the productivity and product quality of the alloy to be obtained is particularly large. As described above, achieving both the productivity and the product quality by appropriately selecting the cooling condition of the ingot in the production of the Cu—Ni—Sn alloy is desired.

Now the present inventors have discovered that by adopting mist cooling in which mist-like liquid is sprayed on the ingot, it is possible to provide a method for producing a Cu—Ni—Sn alloy, which reduces the internal cracks in spite of shortening the time for cooling an ingot and achieves both the productivity and the product quality.

Accordingly, an object of the present invention is to provide a method for producing a Cu—Ni—Sn alloy, which achieves both the productivity and the product quality by reducing the internal cracks in spite of shortening the time for cooling an ingot.

According to an aspect of the present invention, there is provided a method for producing a Cu—Ni—Sn alloy by a continuous casting method or a semi-continuous casting method, the method comprising the steps of:

- pouring a molten Cu—Ni—Sn alloy from one end of a mold, both ends of which are open, and continuously drawing out the alloy as an ingot from the other end of the mold while solidifying a part of the alloy, the part being near the mold; and
- spraying mist-like liquid on the drawn-out ingot to cool the ingot, thereby making a cast product of the Cu—Ni—Sn alloy.

According to another aspect of the present invention, there is provided a cooler for use in a continuous casting method or a semi-continuous casting method, the cooler comprising:

- a cylindrical main body;
- a liquid supply part provided at an upper part of the cylindrical main body and configured in such a way as to discharge liquid downward; and
- an air ejection part that ejects air toward a central axis of the cylindrical main body, the air ejection part provided below the liquid supply part.

DETAILED DESCRIPTION OF THE INVENTION

A production method of the present invention is a method for producing a Cu—Ni—Sn alloy by a continuous casting method or a semi-continuous casting method. The Cu—Ni—Sn alloy which is produced by the method of the present invention is preferably a spinodal alloy containing Cu, Ni, and Sn. This spinodal alloy preferably contains Ni: 8 to 22% by weight and Sn: 4 to 10% by weight, with the balance being Cu and inevitable impurities; the spinodal alloy more preferably contains Ni: 14 to 16% by weight and Sn: 7 to 9% by weight, with the balance being Cu and inevitable impurities; and the spinodal alloy still more preferably contains Ni: 14.5 to 15.5% by weight and Sn: 7.5 to 8.5% by weight, with the balance being Cu and inevitable impurities. Preferred examples of such a Cu—Ni—Sn alloy include Cu-15Ni-8Sn alloy defined as UNS: C72900. When the copper alloy containing Sn having a low melting point as described herein is produced, the internal cracks are liable to occur in a step of cooling an ingot, but according to the method for producing a Cu—Ni—Sn alloy of the present invention, the internal cracks are reduced in spite of shortening the time for cooling the ingot, so that both the productivity and the product quality can be achieved.

The method for producing a Cu—Ni—Sn alloy of the present invention includes (1) a melt-casting step and (2) a cooling step. In the melt-casting step, a molten Cu—Ni—Sn alloy is poured from one end of a mold whose both ends are open and is continuously drawn out as an ingot from the other end of the mold while a part of the alloy, the part being near the mold, is being solidified. In the cooling step that follows the melt-casting step, mist-like liquid is sprayed on the drawn-out ingot, and the ingot is thereby cooled to make a cast product of the Cu—Ni—Sn alloy. By spraying mist-like liquid on the ingot obtained by melt-casting to cool the ingot in this way, that is, by mist cooling the ingot, a Cu—Ni—Sn alloy in which the internal cracks are reduced in spite of shortening the time for cooling the ingot, so that both the productivity and the product quality are achieved can be produced.

As described above, the speed of cooling the ingot gives an influence on the productivity and product quality of an alloy to be obtained in the production of the copper alloy containing Sn having a low melting point, and therefore achieving both the productivity and the product quality has been difficult, but according to the method of the present invention, there is an advantageous point that the Cu—Ni—Sn alloy in which the internal cracks are reduced in spite of shortening the time for cooling the ingot, so that both the productivity and the product quality are achieved can be produced.

Figure 1:
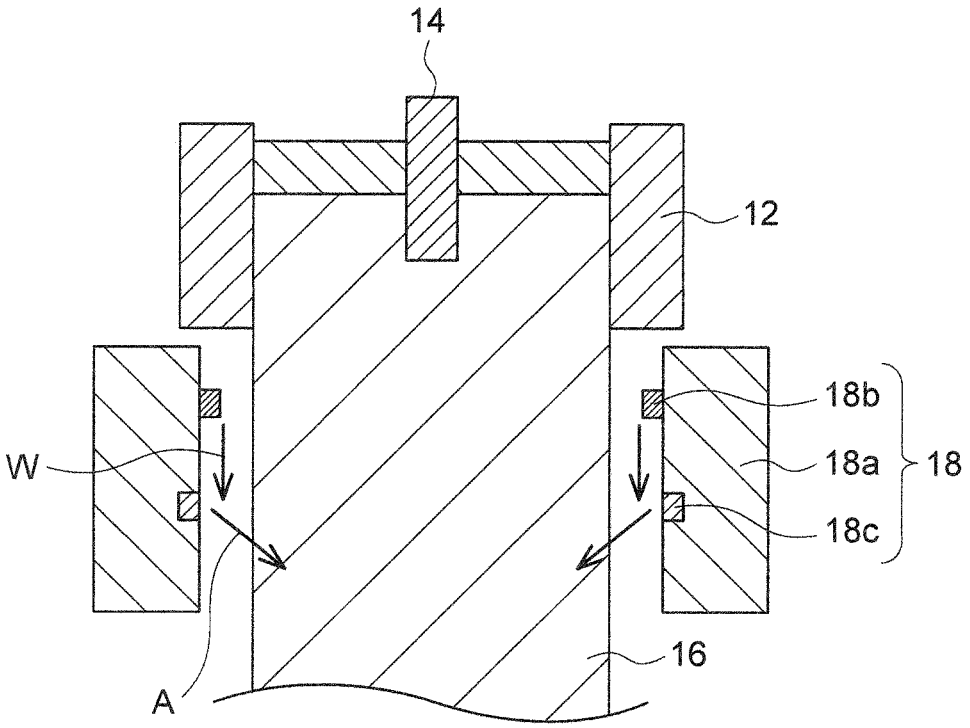
FIG. 1 is a cross-sectional view of a production apparatus including a mold and a cooler, the production apparatus to be used for a production method of the present invention.

FIG. 1 shows a cross-sectional view of a production apparatus and an ingot in one example of the production method of the present invention. Hereinafter, the above-described steps will be described with reference to FIG. 1.

(1) Melt-Casting Step

A molten Cu—Ni—Sn alloy is first poured from one end of a mold 12, both ends of which are open (for example, through a graphite nozzle 14), and is continuously drawn out as an ingot 16 from the other end of the mold 12 while a part of the alloy, the part being near the mold 12, is being solidified. The temperature of the molten Cu—Ni—Sn alloy is preferably 1200 to 1400° C., more preferably 1250 to 1350° C., and still more preferably 1300 to 1350° C.

As the mold 12, a general mold used for casting a copper alloy may be used, and the mold 12 is preferably a mold made of copper though not particularly limited thereto. Cooling medium such as water is preferably circulated inside the mold 12. Thereby, a molten, high-temperature Cu—Ni—Sn alloy can be drawn out continuously as the ingot 16 from the other end of the mold 12 while it is being solidified quickly from the surface layer.

In the melt-casting step, suppression of oxidation is preferably performed by an industrially utilizable method. For example, the melt-casting step is preferably performed in an inert atmosphere, such as nitrogen, Ar, or vacuum, in order to suppress oxidation of the ingot 16.

A pre-treatment, such as a slag treatment or component analysis, for obtaining a desired Cu—Ni—Sn alloy may be performed after melting the Cu—Ni—Sn alloy and before casting the molten Cu—Ni—Sn alloy. For example, casting may be performed after melting the Cu—Ni—Sn alloy at 1300 to 1400° C., making the components uniform through stirring for 15 to 30 minutes, and performing a slag treatment. In addition, part of the Cu—Ni—Sn alloy may be taken out as a sample for component analysis to measure the component values after the slag treatment. When the component values are found to be out of objective component values from the result of this measurement, the Cu—Ni—Sn alloy may be added again to adjust the component values in such a way as to obtain the objective component values.

(2) Cooling Step

The ingot 16 drawn out from the other end of the mold 12 is cooled by spraying mist-like liquid thereon (namely, mist cooling is performed) to make a cast product of the Cu—Ni—Sn alloy. By performing mist cooling, the Cu—Ni—Sn alloy in which the internal cracks are reduced while shortening the time for cooling the ingot 16, so that both the productivity and the product quality are achieved can be obtained. That is, although examples of the conventional method for cooling the ingot 16 containing Cu, Ni, and Sn include direct application of air shower or liquid shower, or direct immersion in liquid, it has been difficult by these methods to reduce the internal cracks in spite of shortening the time for cooling the ingot 16; however, by the mist cooling according to the production method of the present invention, the internal cracks can be reduced while shortening the time for cooling the ingot 16.

In the cooling step, the liquid is not particularly limited as far as it can be used as a cooling medium such as water or oil, but water is preferred from the viewpoint of ease of handling and production cost. From the viewpoint of adjusting the cooling rate, oil may also be used as a cooling medium.

The ingot 16 having passed through the mold 12 is preferably cooled to 50° C. or lower within 2 hours after completion of casting, more preferably cooled to 100° C. or lower within 1 hour after completion of casting, and still more preferably cooled to 500° C. or lower within 0.5 hours after completion of casting. By cooling the ingot 16 in a short time in this way, the casting cycle by a continuous casting method and a semi-continuous casting can be shortened and the productivity can be improved.

In the cooling step, cooling is preferably performed by allowing the ingot 16 to pass through a cooler 18 arranged immediately below the mold 12. Thereby, the ingot 16 is subjected to mist cooling immediately after the ingot 16 is drawn out from the other end of the mold 12, and can be cooled quickly without cracking not only on the surface layer of the ingot 16 but also inside the ingot 16. In addition, when the ingot 16 is drawn out from the other end of the mold 12 and is allowed to pass through the cooler 18 to be lowered, the ingot 16 may be lowered while the ingot 16 is being supported by a receiving table (not shown). The ingot 16 is preferably supported by a receiving table, and the receiving table is lowered at a speed of 25 to 40 mm/min, more preferably lowered at a speed of 25 to 35 mm/min, and still more preferably lowered at a speed of 25 to 30 mm/min.

The preferred cooler 18 includes a cylindrical main body 18*a*, a liquid supply part 18*b*, and an air ejection part 18*c*. The liquid supply part 18*b* is provided at the upper part of the cylindrical main body 18*a* and is configured in such a way as to discharge liquid W downward, and the air ejection part 18*c* is provided below the liquid supply part 18*b* and is configured in such a way as to eject air A toward the central axis of the cylindrical main body 18*a*. According to such a configuration, liquid W discharged from the liquid supply part 18*b* is mixed with air A to make mist-like liquid (namely, mist), and this mist-like liquid can be ejected on the ingot 16 which exists the inside of the cylindrical main body 18*a*.

Thus, shortening of the time for cooling the ingot 16 and suppression of the internal cracks by mist cooling are enabled, so that both the productivity and the product quality of the Cu—Ni—Sn alloy can be achieved. In addition, dust, such as carbon, is contained in discharged liquid W, and therefore the diameter of a nozzle (also referred to as a hole) that ejects air A is desirably adjusted in such a way that the nozzle does not clog up.

The diameter of the nozzle is preferably a diameter of 2 to 5 mm, and more preferably a diameter of 3 to 4 mm. The rate of flow of liquid W which is discharged from the liquid supply part 18*b* is preferably 7 to 13 L/min, and more preferably 9 to 11 L/min. The pressure of air A which is ejected from the air ejection part 18*c* is preferably 2.0 to 4.0 MPa, and more preferably 2.7 to 3.3 MPa.

The cooler 18 is preferably configured in such a way that liquid W which is discharged downward mixes with air A without directly hitting against the ingot 16. Thereby, discharged liquid W does not directly hit against the ingot 16 and the ingot 16 is not quenched locally, and therefore mist cooling can be performed uniformly over the whole ingot 16, so that occurrence of the internal cracks can be more suppressed. In addition, the cooler 18 is preferably configured in such a way that the position of liquid W which is discharged from the liquid supply part 18*b* is nearer to the cylindrical main body 18*a* than the position of the air ejection part 18*c*. Thereby, air A from the air ejection part 18*c* is sprayed well on the place where liquid W is discharged from the liquid supply part 18*b*, so that mist-like liquid (namely, mist) can be generated efficiently.

In addition, the air ejection part 18*c* of the cooler 18 is preferably configured in such a way as to eject air A diagonally downward. When the force of liquid W from the liquid supply part 18*b* is weak, liquid W is discharged downward by gravity and the position where liquid W hits against the ingot as mist-like liquid is lowered, so that unevenness in the cooling speed occurs. However, when the air ejection part 18*c* is configured in such a way as to eject air A diagonally downward, a difference in the position where liquid W hits against the ingot thereby does not occur depending the force of liquid W (amount of liquid), so that cooling speed can be made uniform.

EXAMPLES

The present invention will be described more specifically with reference to the following examples.

Example 1

Comparison

Cu-15Ni-8Sn alloy defined as UNS: C72900 was prepared as a Cu—Ni—Sn alloy and evaluated by the following procedures.

(1) Weighing

A pure Cu nugget, a Nickel metal, a Sn metal, manganese tourmaline, and a Cu—Ni—Sn alloy scrap, which are raw materials for a Cu—Ni—Sn alloy, were weighed in such a way as to obtain an objective composition. That is, Cu in an amount of 163 kg, Ni in an amount of 30 kg, Sn in an amount of 15 kg, and the Cu—Ni—Sn alloy scrap in an amount of 1450 kg were weighed and mixed to be thereby formulated.

(2) Melting and Slag Treatment

The weighed raw materials for a Cu—Ni—Sn alloy were melted in a high-frequency melting furnace for atmospheric air at 1200 to 1400° C. and stirred for 30 minutes to homogenize the components. Slag scraping and slag scooping were performed after completion of melting.

(3) Component Analysis (Before Casting)

Part of the Cu—Ni—Sn alloy obtained by performing the melting and the slag treatment was taken out as a sample for component analysis, and the component values were measured. As a result, it was found that the sample for component analysis contained Ni: 14.9% by weight and Sn: 8.0% by weight, with the balance being Cu and inevitable impurities. This composition satisfies the condition for Cu-15Ni-8Sn alloy defined as UNS: C72900.

(4) Semi-Continuous Casting

The molten metal of the Cu—Ni—Sn alloy which was obtained by performing the melting and the slag treatment was tapped at 1250 to 1300° C. and poured into one end of the mold 12, both ends of which are open, through the graphite nozzle 14, as schematically shown in FIG. 1. On that occasion, the poured molten metal was solidified to make the ingot 16 by the time when the molten metal passed through from the one other end to the other end of the mold 12 by circulating water inside the mold 12. On that occasion, the surface layer of the ingot 16 is mainly solidified.

(5) Cooling (Water Cooling (Immersion Cooling))

After liquid water was sprayed, with the cooler 18 provided immediately below the mold 12, on the ingot 16 whose surface layer had been solidified, the ingot 16 was immersed in a water tank. It is to be noted that on that occasion, air A was not blown from the air ejection part 18*c*. By such a cooling method, the ingot 16 was cooled to 50° C. or lower within 2 hours after the semi-continuous casting of (4) described above.

(6) Taking out Cast Product

The ingot 16 obtained by water cooling was taken out after the temperature of the ingot 16 became lower than 50°

C. to obtain a Cu—Ni—Sn alloy which is a cast product. The size of the cast product was 320 mm in diameter×2 m in length.

(7) Evaluations

The following evaluations were performed for the obtained ingot and the cast product.

<Check of Internal Cracks>

Figure 2:
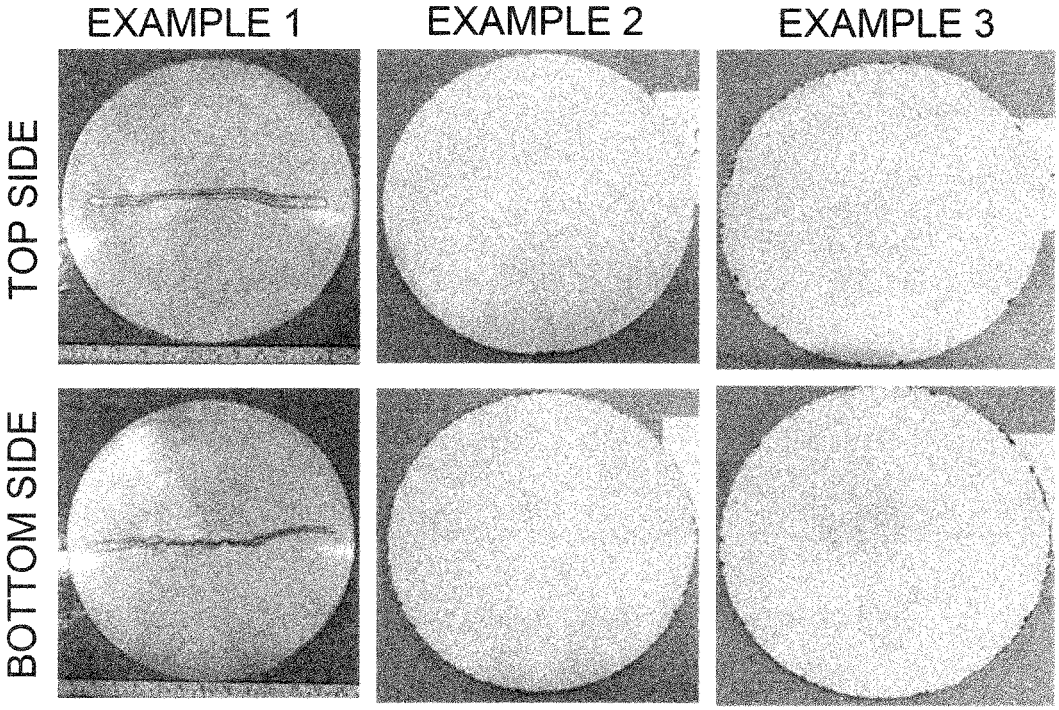
FIG. 2 includes photographs showing cut surfaces (a top surface and a bottom surface) of a sample cut out from each of cast products of Cu—Ni—Sn alloys, the cast products obtained in Examples 1 to 3.

As shown in FIG. 2, a disk-like sample of 320 mm in diameter×10 mm in thickness was cut out from the position of 250 mm from the top surface in the longitudinal direction of the cast product and from the position of 150 mm from the bottom surface in the longitudinal direction of the cast product in order to check the internal cracks of the cast product, and visual observation and a red check were performed on both surfaces of the sample. Photographs of the top surface (written as "Top SIDE" in the figure) and the bottom surface (written as "Bottom SIDE" in the figure) of the sample are shown.

<Secondary DAS Measurement>

Figure 3:
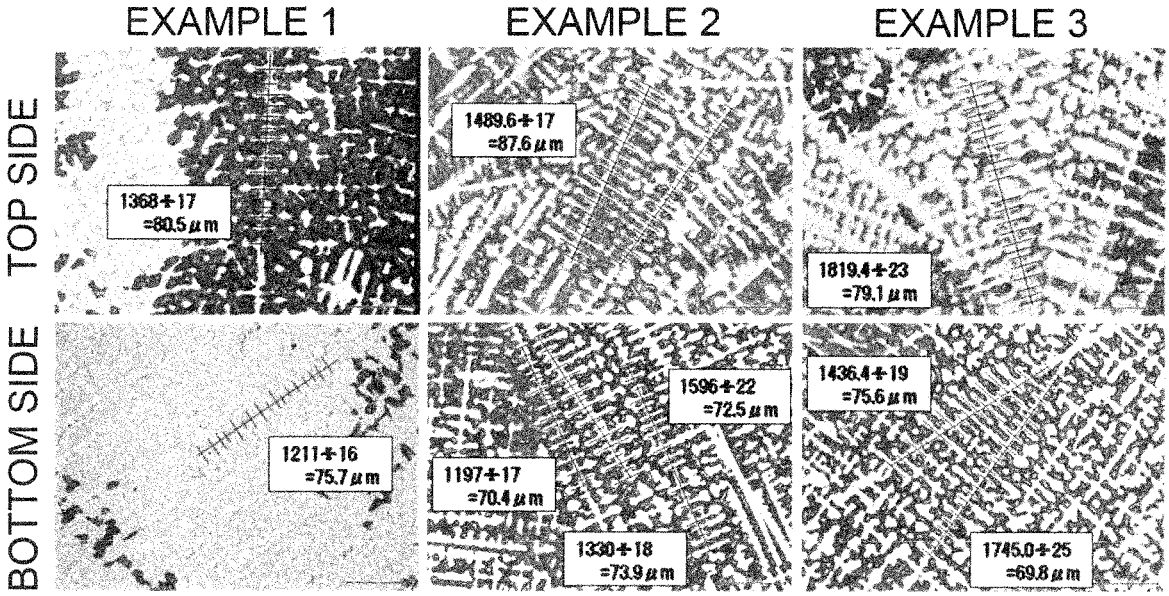
FIG. 3 includes photographs each showing dendrite existing at a cross section perpendicular to cut surfaces of a sample cut out from each of cast products obtained in Examples 1 to 3.

Secondary DAS (secondary dendrite arm spacing) measurement was performed on the above samples to estimate the cooling speed until the molten Cu—Ni—Sn was solidified to become an ingot. First, at a vertical (casting direction) cross section to a position of ½R in the cut surface of the sample, a dendrite having 4 or more consecutive secondary dendrite arms is selected. The position of ½R refers to a position corresponding to the center between the center and circumference of the cut surface (circle) of the disk-like sample (namely, position of ½ of radius). Next, the interval between the consecutive four or more secondary dendrite arms was measured for the dendrite. This interval was adopted as the secondary DAS. Dendrites confirmed at the top surface (written as "Top SIDE" in the figure) and bottom surface (written as "Bottom SIDE" in the figure) of the cross section vertical to the cut surface of the sample and the values of the secondary DAS are shown in FIG. 3.

Example 2

Preparation and evaluations of a sample were performed in the same manner as in Example 1, except that mist cooling was performed in the following manner in place of the water cooling of (5) described above. The obtained cast product had a size of 320 mm in diameter×2 m in length.

(5') Cooling (Mist Cooling)

The solidified ingot 16 was continuously drawn out while mist-like water was being sprayed with the cooler 18 provided immediately below the mold 12, as schematically shown in FIG. 1. On that occasion, by discharging 7 to 13 L/min of water W from the water supply part 18*b* which is at the upper part of the cylindrical main body 18*a* of the cooler 18, and blowing air A at a pressure of 2.7 to 3.3 MPa from 120 holes each having a diameter of 3.5 mm, the holes each provided as the air ejection part 18*c* at the lower stage of the cylindrical main body 18*a* of the cooler 18, discharged water W was atomized into mist-like water (namely, mist) and was sprayed on the ingot 16. In addition, the ingot 16 was lowered while being received by a receiving table (not shown) which was lowered at a speed of 25 mm/min. By such a cooling method, the ingot 16 was cooled to 50° C. or lower within 2 hours after the semi-continuous casting of (4) described above.

Example 3

Comparison

Preparation and evaluations of a sample were performed in the same manner as in Example 1, except that air cooling was performed in the following manner in place of the mist cooling of (5) described above. The obtained cast product had a size of 320 mm in diameter×2 m in length.

(5") Cooling (Air Cooling)

The solidified ingot was continuously drawn out while air was being blown with the cooler provided immediately below the mold. On that occasion, air was blown from 120 holes each having a diameter of 3.5 mm, the holes provided at the cylindrical main body of the cooler, and the ingot was lowered while being received with a receiving table which was lowered at a speed of 25 mm/min. By such a cooling method, the ingot was cooled to 50° C. in 12 hours after the semi-continuous casting of (4) described above. In the case of air cooling, it can be said that the speed of cooling the ingot is slow, and therefore, the internal cracks are unlikely to occur, but the productivity is poor because cooling requires a long time.

In Examples 1 to 3, as shown in FIG. 2, the internal cracks were observed in Example 1 where the cooling method was water cooling, but the internal cracks were not observed in Example 2 where the cooling method was mist cooling and in Example 3 where the cooling method was air cooling. In addition, as shown in FIG. 3, the measured secondary DASs were about the same in Examples 1 to 3. From this, it is inferred that the solidifying speeds of the molten Cu—Ni—Sn alloy are in the same extent in the ingot of Example 1 (water cooling was adopted), and the ingots of Example 2 (mist cooling was adopted) and Example 3 (air cooling was adopted).

What is claimed is:

1. A method for producing a Cu—Ni—Sn alloy by a continuous casting method or a semi-continuous casting method, the method comprising:

pouring a molten Cu—Ni—Sn alloy from one end of a mold, both ends of which are open, and continuously drawing out the alloy as an ingot from the other end of the mold while solidifying a part of the alloy, the part being near the mold; and spraying a liquid mist on the drawn-out ingot to cool the ingot, thereby making a cast product of the Cu—Ni—Sn alloy, wherein the Cu—Ni—Sn alloy is a spinodal alloy comprising 8 to 22% by weight Ni and 4 to 10% by weight Sn, with the balance being Cu and inevitable impurities.

2. The method for producing a Cu—Ni—Sn alloy according to claim 1, wherein the Cu—Ni—Sn alloy is a spinodal alloy comprising 14 to 16% by weight Ni and 7 to 9% by weight Sn, with the balance being Cu and inevitable impurities.

3. The method for producing a Cu—Ni—Sn alloy according to claim 1, wherein the ingot having passed through the mold is cooled to 50° C. or lower within 2 hours after completion of the casting method.

4. The method for producing a Cu—Ni—Sn alloy according to claim 1, wherein cooling is performed by allowing the ingot to pass through a cooler disposed immediately below the mold.

5. The method for producing a Cu—Ni—Sn alloy according to claim 4, wherein the cooler comprises:

a cylindrical main body;

a liquid supply part provided at an upper part of the cylindrical main body and configured in such a way as to discharge liquid downward; and an air ejection part that ejects air toward a central axis of the cylindrical main body, the air ejection part provided below the liquid supply part.

6. The method for producing a Cu—Ni—Sn alloy according to claim 5, wherein the cooler is configured in such a way that the liquid that is discharged downward is mixed with the air without directly hitting against the ingot.

7. The method for producing a Cu—Ni—Sn alloy according to claim 1, wherein the ingot is supported by a receiving table, and the receiving table is lowered at a speed of 25 to 40 mm/min.

8. The method for producing a Cu—Ni—Sn alloy according to claim 1, wherein the liquid is water.

* * * * *